US008584728B2

(12) United States Patent
Truett et al.

(10) Patent No.: US 8,584,728 B2
(45) Date of Patent: Nov. 19, 2013

(54) RAIL FOR COVERINGS FOR ARCHITECTURAL OPENINGS

(75) Inventors: Janice W. Truett, Bessemer City, NC (US); Jean Trantham, legal representative, Dallas, NC (US); Nell Norman, legal representative, Horse Shoe, NC (US); Jesse B. Bowen, Belmont, NC (US); Steve Lathrup, Durham, NC (US)

(73) Assignee: Hunter Douglas Inc., Pearl River, NY (US)

( * ) Notice: Subject to any disclaimer, the term of this patent is extended or adjusted under 35 U.S.C. 154(b) by 344 days.

(21) Appl. No.: 12/714,946

(22) Filed: Mar. 1, 2010
(Under 37 CFR 1.47)

(65) Prior Publication Data

US 2010/0243589 A1 Sep. 30, 2010

Related U.S. Application Data

(60) Provisional application No. 61/158,179, filed on Mar. 6, 2009.

(51) Int. Cl.
*E04F 10/00* (2006.01)
*E06B 3/48* (2006.01)

(52) U.S. Cl.
USPC ..... 160/38; 160/84.01

(58) Field of Classification Search
USPC ..... 160/38, 84.01, 84.02, 84.03, 84.04, 160/84.05; 16/87 R, 87.4 R, 96 R; D6/580
See application file for complete search history.

(56) References Cited

U.S. PATENT DOCUMENTS

| | | | | |
|---|---|---|---|---|
| 3,297,075 | A * | 1/1967 | Howell et al. | 160/19 |
| 4,114,233 | A * | 9/1978 | Hamilton | 16/95 R |
| 4,603,725 | A * | 8/1986 | Knight | 160/243 |
| 4,840,216 | A * | 6/1989 | John | 160/178.1 V |
| 5,054,535 | A * | 10/1991 | Rozon | 160/38 |
| 5,188,162 | A * | 2/1993 | Simon et al. | 160/166.1 |
| 5,417,271 | A * | 5/1995 | Fenley | 160/38 |
| 5,515,901 | A * | 5/1996 | Hall | 160/206 |
| 5,803,144 | A * | 9/1998 | Ives | 160/38 |
| 6,543,516 | B2 * | 4/2003 | Hwang | 160/84.01 |
| 6,601,809 | B1 * | 8/2003 | Gebrara | 248/229.16 |
| 6,712,115 | B2 * | 3/2004 | Judkins | 160/32 |
| 6,988,526 | B2 * | 1/2006 | Judkins | 160/84.01 |
| 7,048,028 | B2 * | 5/2006 | Wolfe et al. | 160/173 R |
| 2002/0046816 | A1 * | 4/2002 | Judkins | 160/32 |
| 2004/0154754 | A1 * | 8/2004 | Judkins | 160/84.01 |
| 2009/0020235 | A1 * | 1/2009 | Honda et al. | 160/84.01 |

* cited by examiner

*Primary Examiner* — Jonathan Liu
*Assistant Examiner* — Patrick Hawn
(74) *Attorney, Agent, or Firm* — Dorsey & Whitney LLP

(57) ABSTRACT

A rail for use in a covering for an architectural opening to secure one edge of a retractable shade material includes a recess opening toward the top or bottom of the rail with the recess being adapted to secure an associated edge of the shade material so that the shade material covers a front of the rail to conceal it from view. The edge of the shade material can be releasably retained within the recess by being connected to a removable insert that can be slidably or otherwise retained within the recess. The recess opens upwardly when the rail is used as a headrail or downwardly when the rail is used as a bottom rail.

16 Claims, 3 Drawing Sheets

RAIL FOR COVERINGS FOR ARCHITECTURAL OPENINGS

CROSS-REFERENCE TO RELATED APPLICATION

The present application claims the benefit under 35 U.S.C. §119(e) to U.S. Provisional Patent Application No. 61/158,179 ("the '179 application"), which was filed on 6 Mar. 2009, and entitled "Rail for Coverings for Architectural Openings." The '179 application is incorporated by reference into the present application in its entirety.

BACKGROUND OF THE INVENTION

1. Field of the Invention

The present invention relates generally to coverings for architectural openings such as windows, doors, archways, and the like, and more particularly to a rail for use in such a covering wherein a shade material can be secured to the rail in a manner to conceal the rail.

2. Description of the Relevant Art

Coverings for architectural openings such as windows, doors, archways, and the like, have taken numerous forms over a long period of time. While some such coverings are not retractable, most include a shade material that can be extended across an architectural opening or retracted adjacent to a headrail or bottom rail adjacent a top or bottom of the architectural opening.

Rails used in such coverings take numerous shapes, which are normally dictated by functionality but sometimes by aesthetics as well. In other words, it is desirable that a rail be aesthetically pleasing so as not to detract from the aesthetics of the shade material or the overall covering.

Some rails have a curvature that is aesthetically pleasing while others might be covered with a fabric which can be tightly fixed to the rail or can hang a short distance from the top of an architectural opening so as to extend beneath the rail thereby sheltering the rail from view from the interior of a room in which the covering is mounted.

The shade material itself can be mounted at an upper edge within a headrail so as to be rolled up within the headrail or depending upon the control system used to extend and retract the shade material, it could also be gathered immediately adjacent the headrail in the retracted position of the covering.

The present invention has been designed to positively affect issues related to the aesthetics of a rail and at the same time provide a shade material that can be extended or retracted through a control system associated with the rail.

SUMMARY OF THE INVENTION

The present invention relates to a rail that extends across the top or bottom of an architectural opening and has a hollow interior in which a control system for extending and retracting a shade material operatively connected to the rail can be incorporated.

While various types of control systems could be utilized for extending and retracting the shade material, for purposes of the present disclosure, the shade material is of the type that is gathered immediately adjacent to the rail when the covering is retracted with the control system within the rail including lift cords connected to the shade material for moving the shade material between extended and retracted positions.

The rail is provided with a recess that is open at least along one edge which would be the top edge if the rail were used at the top of an architectural opening as a headrail or the bottom edge if the rail were used as a bottom rail at the bottom of the architectural opening in a bottom-up type covering. In other words, if the rail were used as a headrail, the shade would extend downwardly and be retracted upwardly, whereas if the rail were used as a bottom rail, the shade would extend upwardly and retract downwardly. In the event the rail was used as a bottom rail, the recess would be open at least along a bottom edge thereof.

The shade material itself which typically is a flexible fabric or other related material has one edge retained within the recess so that the shade material can extend from the recess and be folded in a reverse direction across a front wall of the rail so as to conceal the front wall of the rail from view. In other words, when the rail is used as a headrail, the recess would open upwardly and a top edge of the shade material would be fixed within the recess pointing downwardly and the shade material would extend across a top edge of the headrail and hang downwardly across a front face of the headrail. The opposite would be the case if the rail was used as a bottom rail.

Other aspects, features and details of the present invention can be more completely understood by reference to the following detailed description of a preferred embodiment, taken in conjunction with the drawings and from the appended claims.

DETAILED DESCRIPTION OF THE INVENTION

Figure 1:
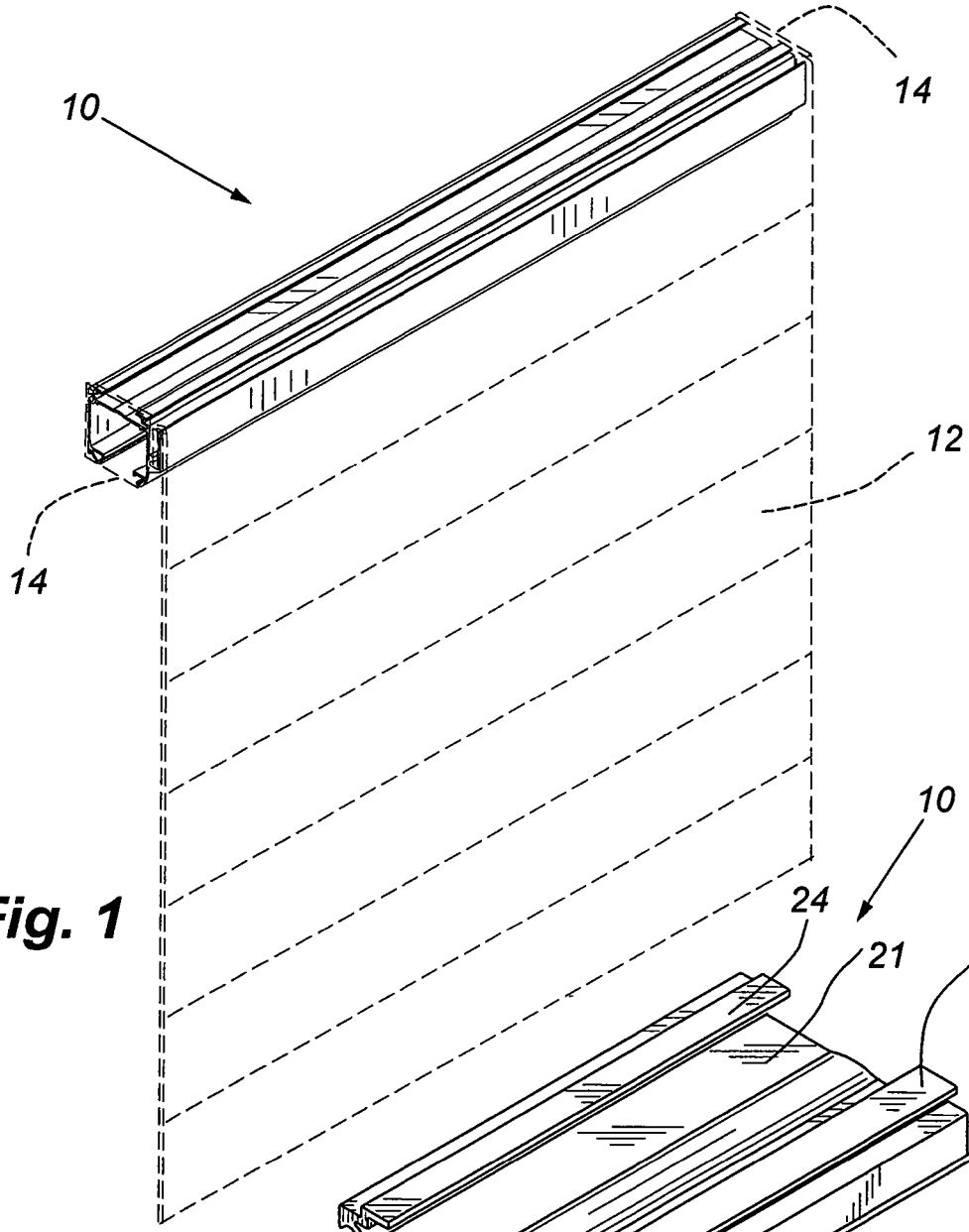
FIG. 1 is an isometric view of the rail of the present invention shown in solid lines and with a shade material suspended therefrom and end caps at opposite ends of the headrail shown in dashed lines.

Referring first to FIG. 1, the rail 10 of the present invention is shown being used as a headrail with a shade material 12 shown in dashed lines secured to and depending from the headrail. The rail could be used as a bottom rail and, if so, it would be inverted and secured to the bottom or lower end of the shade material. When used as a headrail, the shade material extends downwardly from the headrail and can be retracted upwardly toward the headrail while if it were used as a bottom rail, the shade material would extend upwardly from the rail and be retracted downwardly toward the rail.

As shown in FIG. 1, the rail 10 would have conventional end caps 14 typically tightly fitted in opposite open ends of the rail.

For purposes of the present disclosure, the rail 10 will be described as a headrail and therefore the drawings have been oriented and described for this use.

As best appreciated by reference to FIGS. 2-8, the rail 10 has a main body 16 of generally inverted U-shaped cross-section having inwardly directed longitudinally-extending lips 18 along the lower edges which confront each other and define a gap 20 therebetween through which control cords, shade material, or the like, can extend. The lips may support a removable bottom wall 23 that does not form an integral part of the rail. Above a top wall 21 of the head rail, a pair of inwardly directed, longitudinally-extending lips 24 confront each other and are adapted to be operatively connected to brackets (not shown) in a conventional manner along a style of an architectural opening to secure the head rail in the orientation shown, for example, in FIG. 1. The lips 18 and 24 are formed off a rear 25 and front 26 wall. The front wall 26 of the main body is spaced from a parallel auxiliary wall 28 and is connected to the auxiliary wall with a bottom wall 30 so that an upwardly opening recess or channel 32 is defined. The recess also has open ends 34. A longitudinally-extending ledge 36 is formed in the front wall of the main body protruding toward the auxiliary wall and is spaced from the bottom wall so as to define a gap 38 between the ledge and the auxiliary wall. The ledge is arcuate along a bottom extent 40 and is continuous with an arcuate wall 42 formed in the front wall of the main body which in turn is continuous with the bottom surface 44 of the recess.

A seat 46 is therefore defined by the ledge 36, auxiliary wall 28, and bottom surface 44 of the recess which is adapted to slidingly receive an insert 48 made of any suitable material such as plastic, which can be slid into the recess through an open end 34 of the recess. The insert has a lower segment 50 conforming in configuration to the seat and a flat planar upward segment 52 which fits against an inner surface of the auxiliary wall when the insert is positioned within the recess. In other words, the lower segment 50 of the insert has a horizontal bottom leg 54, an arced leg 56 at one end thereof, a vertical leg 58 at the opposite end of the arced leg from the bottom leg, and a top leg 60 that is parallel to the bottom leg and is connected to the bottom edge of the planar segment 52.

Figure 2:
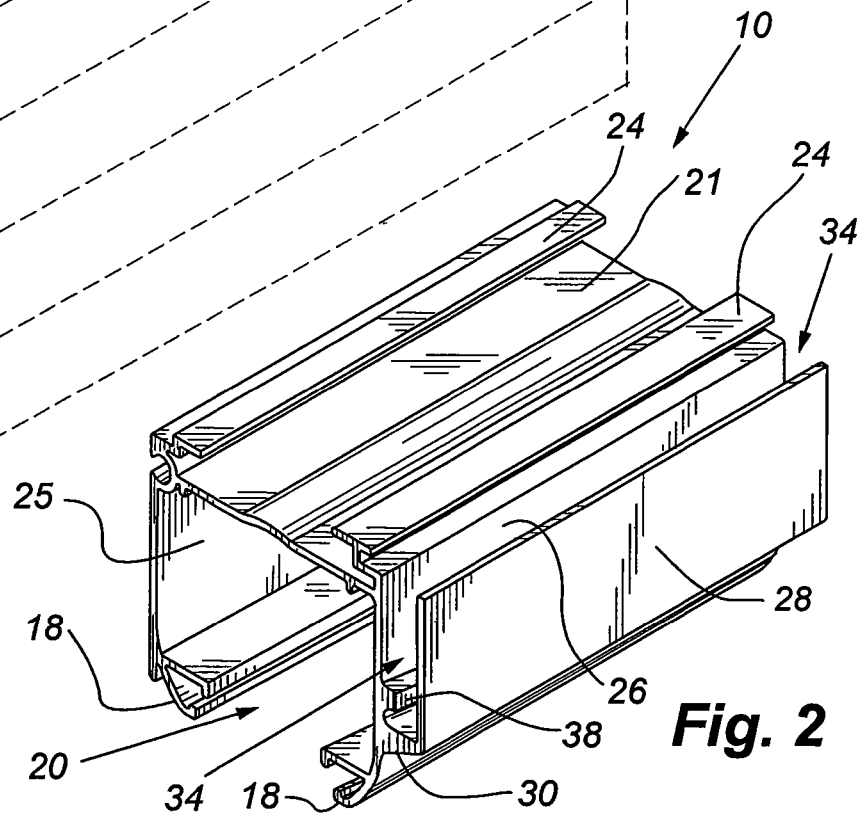
FIG. 2 is an isometric of a shortened portion of the rail as shown in FIG. 1 without the shade material or end caps.
Figure 3:
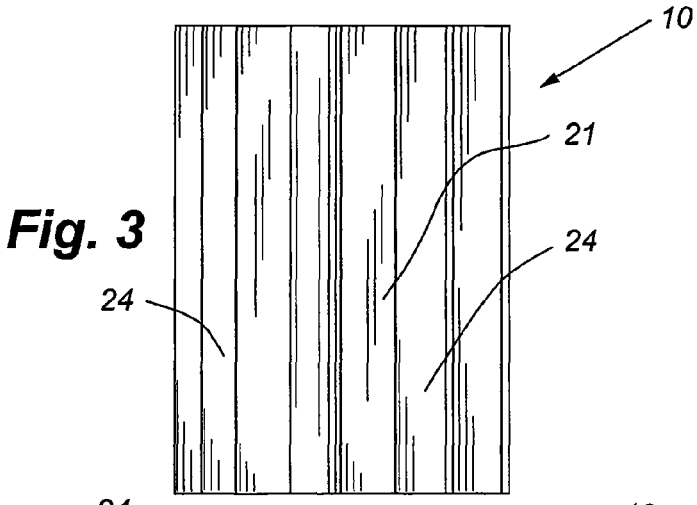
FIG. 3 is a top plan view of the rail shown in FIG. 2.
Figure 4:
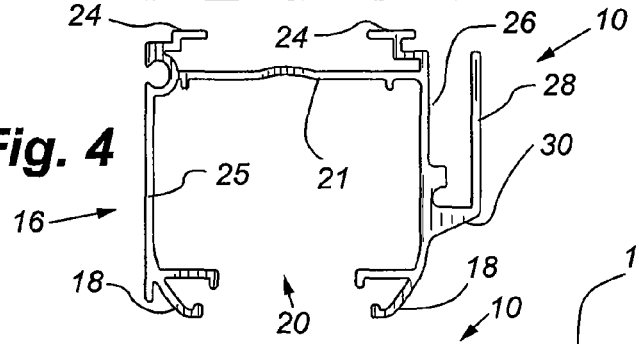
FIG. 4 is an end view of the rail shown in FIG. 4.
Figures 5, 6, 7:
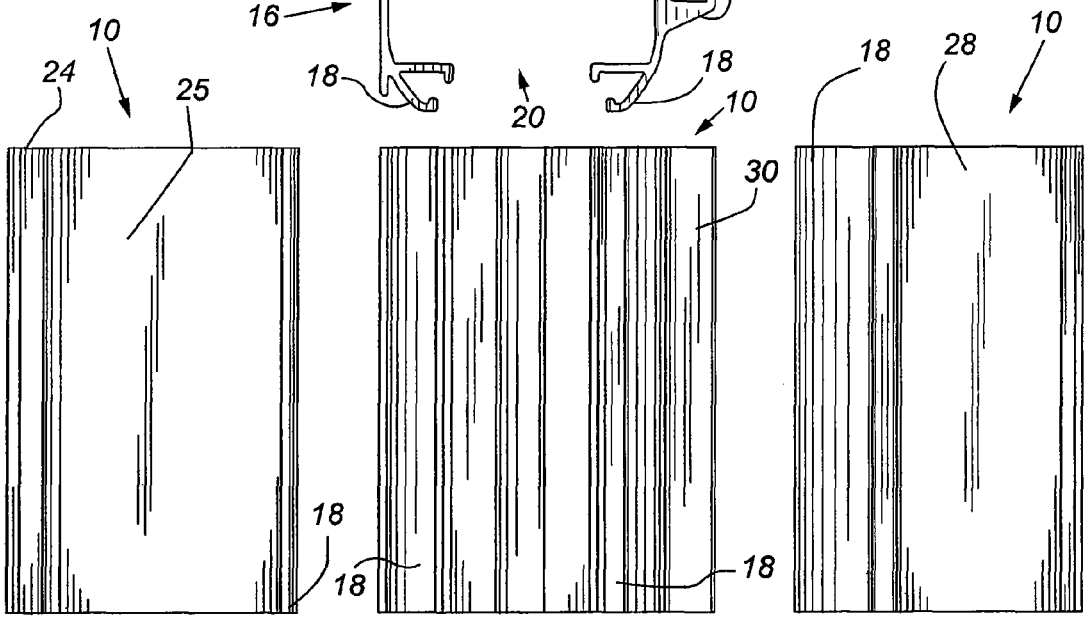
FIG. 5 is a rear elevation of the rail shown in FIG. 2.
FIG. 6 is a bottom plan view of the rail shown in FIG. 2.
FIG. 7 is a front elevation of the rail shown in FIG. 2.

The recess 32, as can be appreciated by reference to FIG. 2, opens at opposite ends so that the insert 48 can be slidably inserted therein even though if the ends of the recess were closed in an alternative embodiment (not shown) of the rail, the insert could be designed of a resilient material that could be snap-fit into the seat defined within the recess by inserting the insert downwardly into the recess and snapping the bottom portion thereof into the seat 46.

Figure 8:
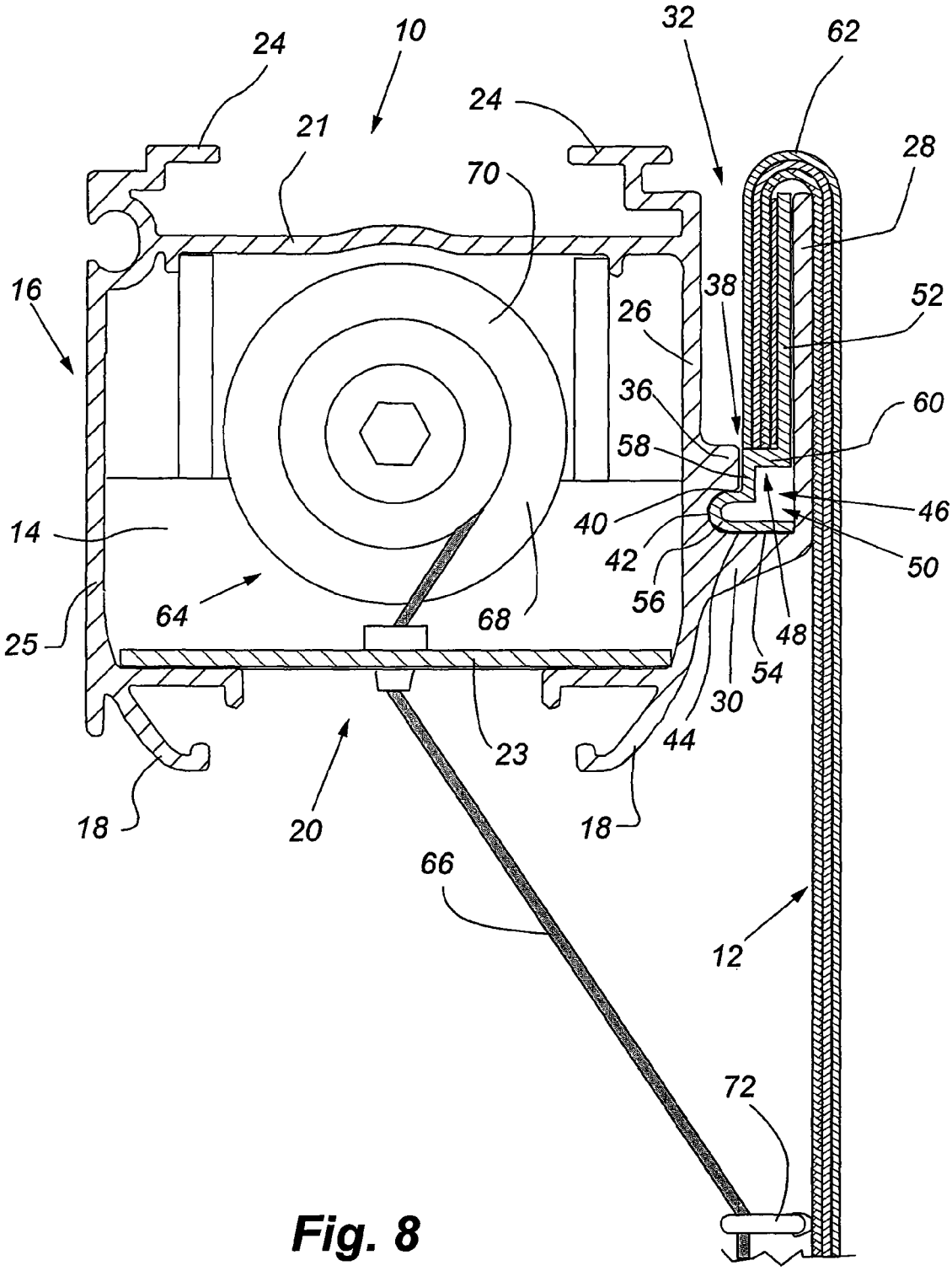
FIG. 8 is a vertical section taken through the rail showing a shade material operatively connected thereto and a control system for extending and retracting the shade material.

Before inserting the insert 48 into the headrail 10, the top edge of the shade material 12, which is shown in FIG. 8 as a three-layer laminate, is secured to the face of the planar segment of the insert which faces the front wall 26 of the main body of the rail. This attachment can be made with adhesive, ultrasonic bonding, or any other suitable system including rivets or the like. The shade material extends upwardly out of the recess and then is inverted in direction so as to hang downwardly and define a fold 62 across the top edge of the auxiliary wall 28. The shade material then covers and lies in substantially contiguous or close relationship with the outer surface of the auxiliary wall and extends downwardly so that its lower edge would be adjacent to the bottom edge of the architectural opening in which the shade material is suspended.

The insert 48 could be replaced with a magnetic or ratchet-type system (not shown) which would provide an easily adjustable system for anchoring the top edge of the shade material to the rail 10. A workable magnetic or ratchet-type system is felt to be within the skill of those in the art and, accordingly, a detailed description thereof is not deemed necessary. It will be appreciated, however, that by providing an adjustable connection system between the shade material and the rail 10, the length of the shade material can be easily adjusted to fit the height of the architectural opening in which the shade material is suspended.

As mentioned previously, for purposes of the present disclosure, the shade material 12 is shown being of the conventional type that can be gathered with a control system 64 (FIG. 8) from a fully extended position across the architectural opening (FIG. 1) to a position that is not illustrated adjacent to the headrail. The retraction of the shade material into the gathered position is accomplished with a lift cord 66 that can be wrapped about or unwrapped from a spool 68 mounted within the headrail 10 and rotated in reversible directions in any suitable manner such as with a motor 70 or a control cord which is not illustrated. The shade material would have eyelets 72 secured on its inner face through which the lift cord extends with the lift cord then being secured to the fabric adjacent a lower edge in a conventional manner. There would typically be at least two lift cords so the shade material could be retracted in a uniform horizontal manner.

It will be appreciated from the above that the shade material 12 covers the front face of the auxiliary wall 28 and therefore the front of the headrail itself regardless of whether the shade material is extended or retracted. It therefore functions as a valence in addition to a retractable shade that can cover or not cover the architectural opening by extending or retracting the shade material respectively.

Although the present invention has been described with a certain degree of particularity, it is understood the disclosure has been made by way of example, and changes in detail or structure may be made without departing from the spirit of the invention as defined in the appended claims.

What is claimed is:

1. A rail for use in an architectural opening for extending a shade material therefrom, said rail comprising:

a longitudinally-extending main body with a front wall, a recess along said front wall of the main body that opens upwardly between an auxiliary wall spaced forwardly of said front wall of the rail, and a ledge positioned below a top end of said auxiliary wall and extending inwardly into said recess; and an insert removably seated in said recess, said insert including:

a first vertically-oriented segment positioned in abutting relationship with said front wall and positioned below said ledge;

a second vertically-oriented segment spaced forwardly of, and extending above, said first vertically-oriented segment and positioned in abutting relationship with a front extent of said ledge; and a third vertically-oriented segment spaced forwardly of, and extending above, said first and second vertically-oriented segments and positioned in abutting relationship with an inner surface of said auxiliary wall.

2. The rail of claim 1 further comprising a shade material secured to said insert.

3. The rail of claim 1 wherein said insert is snap-fit within said recess.

4. The rail of claim 1 wherein said insert further includes a first horizontally-oriented segment positioned below said ledge and extending between said auxiliary wall and said front wall of the rail.

5. The rail of claim 1 wherein said rail includes a top wall and said auxiliary wall extends higher than said top wall.

6. The rail of claim 4 wherein said insert further includes a second horizontally-oriented segment spaced above said first horizontally-oriented segment.

7. The rail of claim 6 wherein said second horizontally-oriented segment extends between said front extent of said ledge and said inner surface of said auxiliary wall.

8. A rail for use in an architectural opening, the rail comprising:

a rear wall;

a front wall spaced forwardly from the rear wall;

a top wall extending between the rear wall and the front wall;

an auxiliary wall spaced forwardly from the front wall;

a bottom wall interconnecting the front wall and the auxiliary wall to define an upwardly opening channel extending between the front wall, the auxiliary wall, and the bottom wall;

a ledge defining a seat within the channel between the ledge and the bottom wall; and an insert removably seated in the channel, the insert including a planar, upward segment and a lower segment, the planar, upward segment abutted against the auxiliary wall, the lower segment having a pair of vertically-spaced legs positioned within the channel and extending transversely relative to the front and auxiliary walls and an upwardly-extending leg extending between the pair of vertically-spaced legs adjacent to a front extent of the ledge, wherein one of the pair of vertically-spaced legs extends below the ledge between the front wall and the auxiliary wall.

9. The rail of claim 8, wherein the auxiliary wall extends higher than the top wall.

10. The rail of claim 8, wherein the ledge is formed in the front wall and protrudes toward the auxiliary wall.

11. The rail of claim 8, wherein the ledge has a flat face oriented substantially parallel to the front wall.

12. The rail of claim 8, wherein the channel has open ends.

13. The rail of claim 8, wherein the front wall and the auxiliary wall are parallel.

14. A rail for use in an architectural opening, the rail comprising:

a front wall;

an auxiliary wall laterally spaced from the front wall;

a bottom wall interconnecting the front wall and the auxiliary wall to define an upwardly opening recess between the front wall, the auxiliary wall, and the bottom wall;

a ledge formed in the front wall and spaced above the bottom wall; and an insert removably seated in the recess, the insert having a planar, upward segment and a lower segment, the planar, upward segment abutted against the auxiliary wall, the lower segment including an upper leg and a lower leg each positioned within the recess and each extending transversely relative to the front and auxiliary walls, the lower leg spaced below the upper leg to define a gap between the upper and lower legs, wherein the upper leg extends between the ledge and the auxiliary wall, wherein the lower leg extends below the ledge between the front wall and the auxiliary wall, and wherein the lower segment of the insert further includes a vertical leg extending between the upper leg and the lower leg adjacent to a front extent of the ledge.

15. The rail of claim 14, further comprising a shade material secured to the planar, upward segment of the insert.

16. The rail of claim 14, wherein the lower segment of the insert further includes an arched leg extending between an end of the vertical leg and an end of the lower leg.

* * * * *